US009483004B2

(12) United States Patent
Miura et al.

(10) Patent No.: US 9,483,004 B2
(45) Date of Patent: Nov. 1, 2016

(54) IMAGE FORMING APPARATUS FOR REDUCING FLUCTUATION OF TONER DENSITY IN A DEVELOPING UNIT

(71) Applicant: CANON KABUSHIKI KAISHA, Tokyo (JP)

(72) Inventors: Shusuke Miura, Toride (JP); Jiro Shirakata, Chigasaki (JP); Kana Oshima, Ako (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/995,495

(22) Filed: Jan. 14, 2016

(65) Prior Publication Data

US 2016/0209796 A1 Jul. 21, 2016

(30) Foreign Application Priority Data

Jan. 16, 2015 (JP) ..... 2015-007189

(51) Int. Cl.
*G03G 15/08* (2006.01)
*G03G 15/00* (2006.01)

(52) U.S. Cl.
CPC ..... *G03G 15/556* (2013.01); *G03G 15/0824* (2013.01); *G03G 15/0831* (2013.01)

(58) Field of Classification Search
CPC ..... G03G 15/0831; G03G 15/0824
USPC ..... 399/27, 29, 30
See application file for complete search history.

(56) References Cited

U.S. PATENT DOCUMENTS

2009/0290887 A1* 11/2009 Murauchi ..... G03G 15/0844 399/27
2015/0168904 A1* 6/2015 Miura ..... G03G 15/0879 399/27

FOREIGN PATENT DOCUMENTS

JP 09127780 A 5/1997

OTHER PUBLICATIONS

U.S. Appl. No. 14/990,132, filed Jan. 7, 2016, Jiro Shirakata, Shusuke Miura, Kana Oshima.

* cited by examiner

*Primary Examiner* — Hoang Ngo
(74) *Attorney, Agent, or Firm* — Fitzpatrick, Cella, Harper & Scinto

(57) ABSTRACT

A replenishment unit replenishes a storage unit with toner. A detection unit detects a toner density of developer in the storage unit. A stoppage unit stops, based on the toner density, an image forming operation. A first calculation unit controls the detection unit to detect the toner density in a duration from when the operation stops to when the image forming unit resumes the operation, and calculates a difference between the toner density and a target. A second calculation unit accumulates the difference to obtain a cumulative value. A determination unit determines a value for determining whether or not replenishment of the toner is required, based on the difference calculated and the cumulative value calculated. A controller controls a timing at which the replenishment unit replenishes the storage unit with the toner in the duration based on the value.

16 Claims, 7 Drawing Sheets

IMAGE FORMING APPARATUS FOR REDUCING FLUCTUATION OF TONER DENSITY IN A DEVELOPING UNIT

BACKGROUND OF THE INVENTION

1. Field of the Invention

The present invention relates to an image forming apparatus for reducing a fluctuation of toner density in a developing unit.

2. Description of the Related Art

A two-component developer is a developer including a toner and a carrier. An image forming apparatus develops an electrostatic latent image by causing a frictional electrification by mixing the toner and the carrier, and causing the toner to fly towards a photosensitive member. It is necessary for the toner to be replenished because it is consumed by developing. Also, in order to keep the density of the toner image at a desired density, it is necessary that a proportion between the toner and the carrier (a T/D ratio) to be maintained fixedly. The T/D ratio is an indicator of a toner density in the developing unit.

In accordance with Japanese Patent Laid-Open No. H09-127780, it is proposed that replenishment control in accordance with two-component developer toner density (feedback control), and replenishment control in accordance with a toner consumption amount estimated from an image signal (feedforward control) be switched.

In Japanese Patent Laid-Open No. H09-127780, because toner is replenished in parallel to image formation, when the T/D ratio changes greatly due to toner replenishment during image formation, an unevenness in the density of an image formed on a recording medium may occur. Accordingly, a configuration for replenishing a toner after having first stopped image formation when the toner is significantly insufficient is investigated.

SUMMARY OF THE INVENTION

In accordance with a first aspect, the present invention reduces a fluctuation of toner density by introducing a normal sequence and an emergency sequence. In accordance with a second aspect, the present invention, in addition to introducing the normal sequence and the emergency sequence, stabilizes a T/D ratio when moving into the normal sequence from the emergency sequence.

The present invention provides an image forming apparatus, comprising the following elements. A storage unit stores developer including a toner and a carrier. An image forming unit forms an image on a sheet using the toner stored in the storage unit. A replenishment unit replenishes the storage unit with toner. A detection unit arranged in the storage unit detects a toner density of the developer in the storage unit. A stoppage unit stops, based on the toner density detected by the detection unit, an image forming operation of the image forming unit forming the image on the sheet. A first calculation unit controls the detection unit to detect the toner density in a duration from when the stoppage unit stops the image forming operation to when the image forming unit resumes the image forming operation, and calculates a difference between the toner density and a target toner density. A second calculation unit accumulates the difference calculated by the first calculation unit to calculate a cumulative value of the difference. A determination unit determines a value for determining whether or not replenishment of the toner is required, based on the difference calculated and the cumulative value calculated. A controller controls a timing at which the replenishment unit replenishes the storage unit with the toner in the duration based on the value determined by the determination unit.

Further features of the present invention will become apparent from the following description of exemplary embodiments (with reference to the attached drawings).

DESCRIPTION OF THE EMBODIMENTS

An image forming apparatus to which the present embodiment can be applied forms a latent image corresponding to an image signal by an electrophotographic method, an electrostatic recording method or the like on an image carrier such as a photosensitive member, a dielectric or the like, for example, and forms a visible image (toner image) by developing the latent image using a two-component developer. The two-component developer is a developer whose principal components are toner particles and carrier particles.

<Image Forming Apparatus Configuration>

Figure 1:
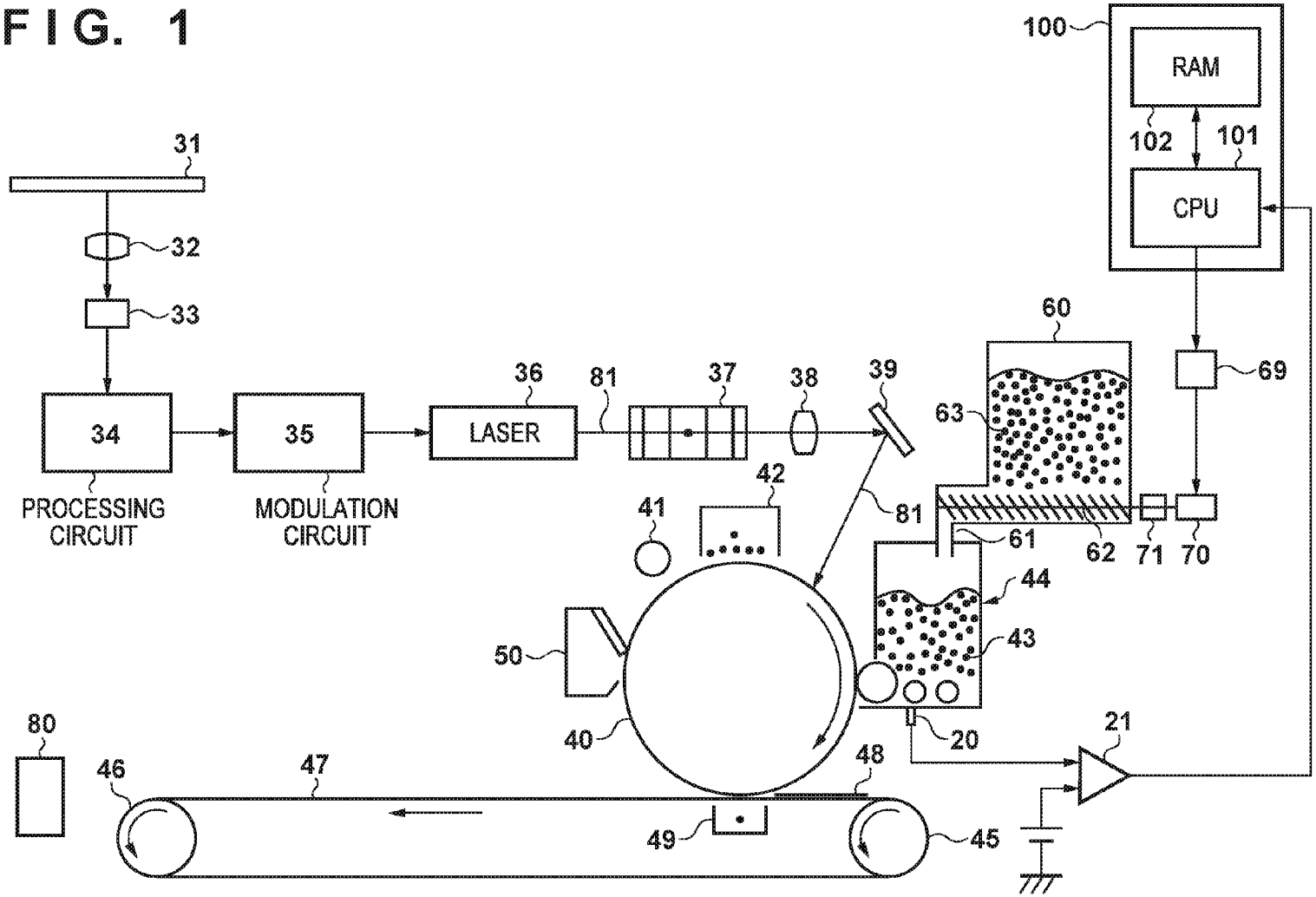
FIG. 1 is a view for illustrating an overall image of an image forming apparatus.

In FIG. 1, an image of an original 31 to be copied is projected to an image sensor 33 such as a CCD by a lens 32. The image sensor 33 breaks the image of the original 31 into a large number of pixels, and generates an analog image signal corresponding to a density of each pixel. A processing circuit 34 is an image processing circuit for converting an image signal output from the image sensor 33 into a pixel signal having an output level corresponding to a density of the pixel for each pixel, and sends that to a modulation circuit 35. The modulation circuit 35 is a pulse width modulation circuit that, for every inputted pixel signal, forms a laser driving pulse of a width (duration) corresponding to that output level, and outputs that to a semiconductor laser 36. For a pixel signal of a high density, a driving pulse of a wide width is formed. For a pixel signal of a low density, a driving pulse of a narrow width is generated. For a pixel signal of an intermediate density, a driving pulse of an intermediate width is formed. The semiconductor laser 36 emits only at a time corresponding to the pulse width of the laser driving pulse. Accordingly, the semiconductor laser 36 emits for a longer time for a high density pixel, and emits for a shorter time for a low density pixel. Thus, a photosensitive drum 40 is exposed for a longer range in a main scanning direction for a high density pixel, and is exposed for a shorter range in the main scanning direction for a low density pixel. In other words, dot sizes of an electrostatic latent image differ corresponding to the density of the pixels.

Accordingly, the toner consumption amount for a high density pixel is greater than the toner consumption amount for a low density pixel.

A laser beam 81 emitted from the semiconductor laser 36 is deflected by a rotational polygonal mirror 37, passes a lens 38, such as an f/e lens, and is caused to form an image on the photosensitive drum 40 by a fixed mirror 39. The laser beam 81 scans the photosensitive drum 40 in a direction (the main scanning direction) substantially parallel to a rotation axis of the photosensitive drum 40 to form the electrostatic latent image. Note that a light source such as an LED array may be used in place of the semiconductor laser 36 as the latent image forming unit.

The photosensitive drum 40 is uniformly charged by a primary charger 42 after uniformly removing electric-charge by an exposure unit 41. After that, an electrostatic latent image is formed by the photosensitive drum 40 being scanned by a laser beam. A developing unit 44 which is a development unit forms a visible image (toner image) by a reversal development of an electrostatic latent image using a developing material 43 of a two-component type in which toner particles and carrier particles are mixed. Reversal development is a development method for causing toner that is charged to the same polarity as the latent image to be attached to a region that is exposed on the surface of the photosensitive drum 40, and to visualize this. A transfer charger 49 transfers a toner image to a transfer material 48 that is carried on a carry belt 47. The carry belt 47 is stretched between 2 rollers 45 and 46, and is driven in an arrow symbol direction. The transfer material is also referred to as a recording material, a recording medium, a paper, a sheet, a transfer material, or a transfer sheet.

Note that only one image forming station (including the photosensitive drum 40, the exposure unit 41, the charger 42, the developing unit 44, or the like) is shown graphically to simplify the explanation. In the case of a color image forming apparatus, four image forming stations corresponding to each color of, for example cyan, magenta, yellow, and black are arranged in a movement direction of the transfer material 48. Each respective toner image of a different color is overlapped sequentially and transferred to the transfer material 48. The image forming station functions as an image forming unit for forming an image on a sheet.

The transfer material 48 to which the toner image is transferred is separated from the carry belt 47 and is conveyed to a fixing unit 80. The fixing unit 80 causes the toner image to be fixed by heating and pressurizing the toner image and the transfer material 48. A cleaner 50 removes residual toner remaining on the photosensitive drum 40 after the transferring.

A CPU 101 causes various parameters that are necessary for the replenishment of toner to be stored in a storage apparatus such as a RAM 102. The CPU 101 determines a toner replenishment amount based on an output value of an inductance sensor 20, and drives a replenishment motor 70 by controlling a motor driver 69 in accordance with the replenishment amount. Output values of the inductance sensor 20 correlate to the T/D ratio which is an indicator of toner density. Generally, if the replenishment amount is high, the driving time for the replenishment motor 70 is longer, and if the replenishment amount is low, the driving time for the replenishment motor 70 is shorter. A rotating speed of the replenishment motor 70 is fixed, and therefore the total amount of toner that is replenished is adjusted by adjusting the driving time. A driving force of the replenishment motor 70 is transmitted to a conveying screw 62 via a gear array 71. The conveying screw 62 replenishes the developing unit 44 with a toner 63 in a toner replenishment basin 60 through a toner conveyance path 61. The inductance sensor 20 is arranged on the developing unit 44 in order to detect toner density (the T/D ratio) in the two-component developer stored in the developing unit 44. In place of the inductance sensor 20, an optical T/D ratio sensor may be used. The present embodiment can use a sensor if it can detect the T/D ratio, and is not dependent upon the detection method. In this way, the toner replenishment basin 60, the conveying screw 62 and the replenishment motor 70 function as replenishment units for replenishing the developing unit 44 with toner.

<Developing Unit Details>

Figure 2:
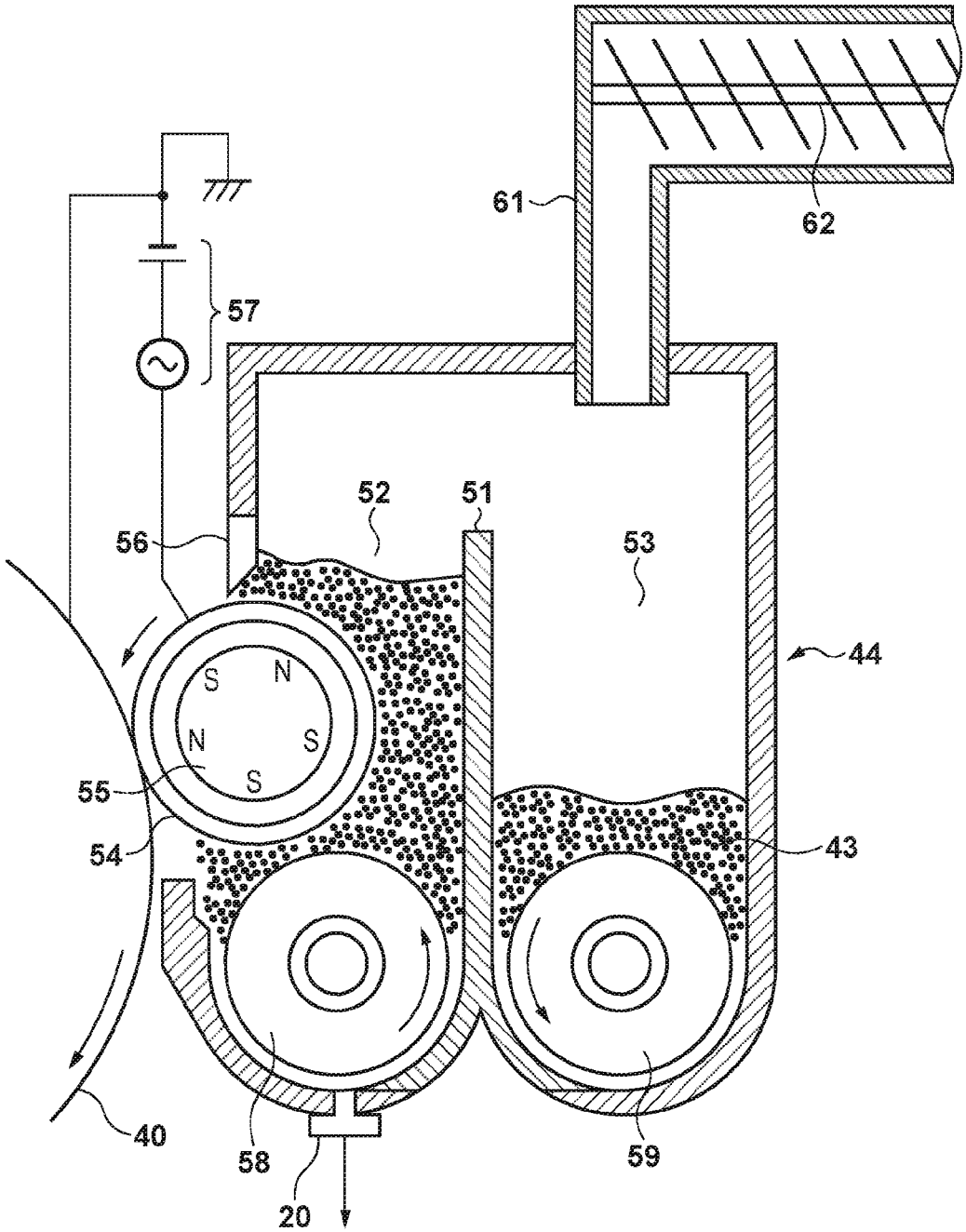
FIG. 2 is a cross-sectional view of a developing unit.

Using FIG. 2, an example of the developing unit 44 is explained. The developing unit 44 is arranged opposing the photosensitive drum 40. The inside of the developing unit 44 is separated into a first chamber (developing chamber) 52 and a second chamber (mixing chamber) 53 by a partition 51 that extends in a vertical direction. The first chamber 52 is an example of a storage unit for storing developer including toner and carrier. A non-magnetic developing sleeve 54 rotating in the arrow symbol direction is arranged in the first chamber 52. The developing sleeve 54 is an example of a developer carrier for developing the electrostatic latent image formed on the image carrier by a toner of the developer stored in the first chamber 52. A magnet 55 is arranged in a fixed manner within the developing sleeve 54. The developing sleeve 54 carries and conveys the two-component developer, and develops an electrostatic latent image by supplying the photosensitive drum 40 with toner at a developing region facing the photosensitive drum 40. Note that a blade 56 restricts the thickness of the two-component developer (including a magnetic carrier and a non-magnetic toner) to be fixed. In order to cause developing efficiency, i.e. a rate at which the toner is added to the latent image to improve, a developing bias is applied from a power supply 57 to the developing sleeve 54. The developing bias is generated by superimposing a direct current voltage on an alternating voltage.

Figure 3:
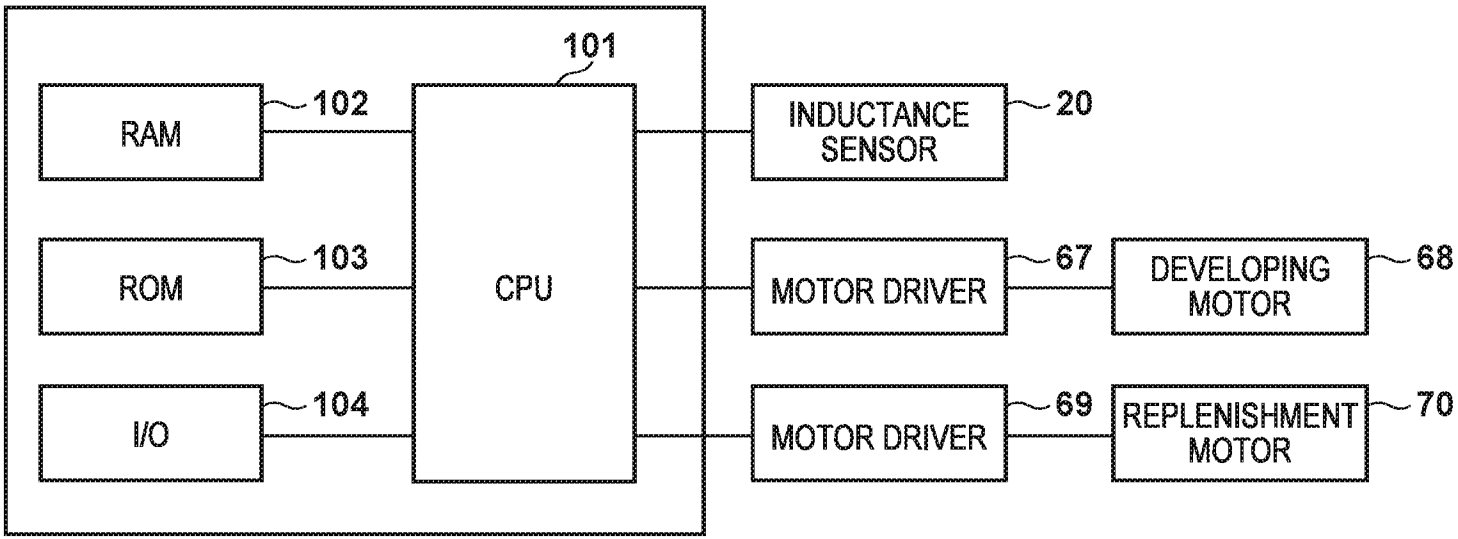
FIG. 3 is a block diagram for illustrating a control unit.

In the first chamber 52 and a second chamber 53 screws 58 and 59 which are mixing units for mixing developer are arranged respectively. The screws 58 and 59 are also referred to as developing screws, mixing screws, and mixing conveying screws. The CPU 101 causes the screws 58 and 59 to rotate by controlling a developing motor 68 (FIG. 3). The screw 58 conveys developer in the first chamber 52 while mixing. The screw 59 uniformizes toner density by conveying while mixing the toner 63 supplied from the toner conveyance path 61 of the toner replenishment basin 60 and the developing material 43 which is already in the developing unit 44. A developer path (not shown) that allows mutual communication between the first chamber 52 and the second chamber 53 is formed in the front side and far side end portions in FIG. 2 in the partition 51. The screw 58 causes developer within the first chamber 52, for which the toner density has lowered due to toner being consumed by developing, to move into the second chamber 53 through one path. The screw 59 causes developer in the second chamber 53 whose toner density has been recovered to move into the first chamber 52 from the other path.

As FIG. 2 illustrates, the inductance sensor 20 which is for detecting toner density is installed on the bottom wall of the first chamber 52 of the developing unit 44. The inductance sensor 20 is an example of a detection unit for detecting toner density of developer stored in the first chamber 52. Here, the inductance sensor 20 outputs to the CPU 101 a detected value corresponding to the actual toner density of the developing material 43 that is present in the first chamber 52. Note that the toner density of the developing material 43 is a parameter indicating a ratio of toner in the developing material 43.

Using FIG. 3, a replenishment controller 100 is explained. The RAM 102, a ROM 103, and an I/O 104 are connected to the CPU 101. The CPU 101 executes control programs stored in the ROM 103 in accordance with signals input to the I/O 104. The CPU 101, in accordance with a control program, retrieves data such as an output value of the inductance sensor 20 from the RAM 102, and drives the developing motor 68 and the replenishment motor 70 by controlling a motor driver 67 and the motor driver 69.

<Flowchart>

(1) Main Sequence

Figure 4:
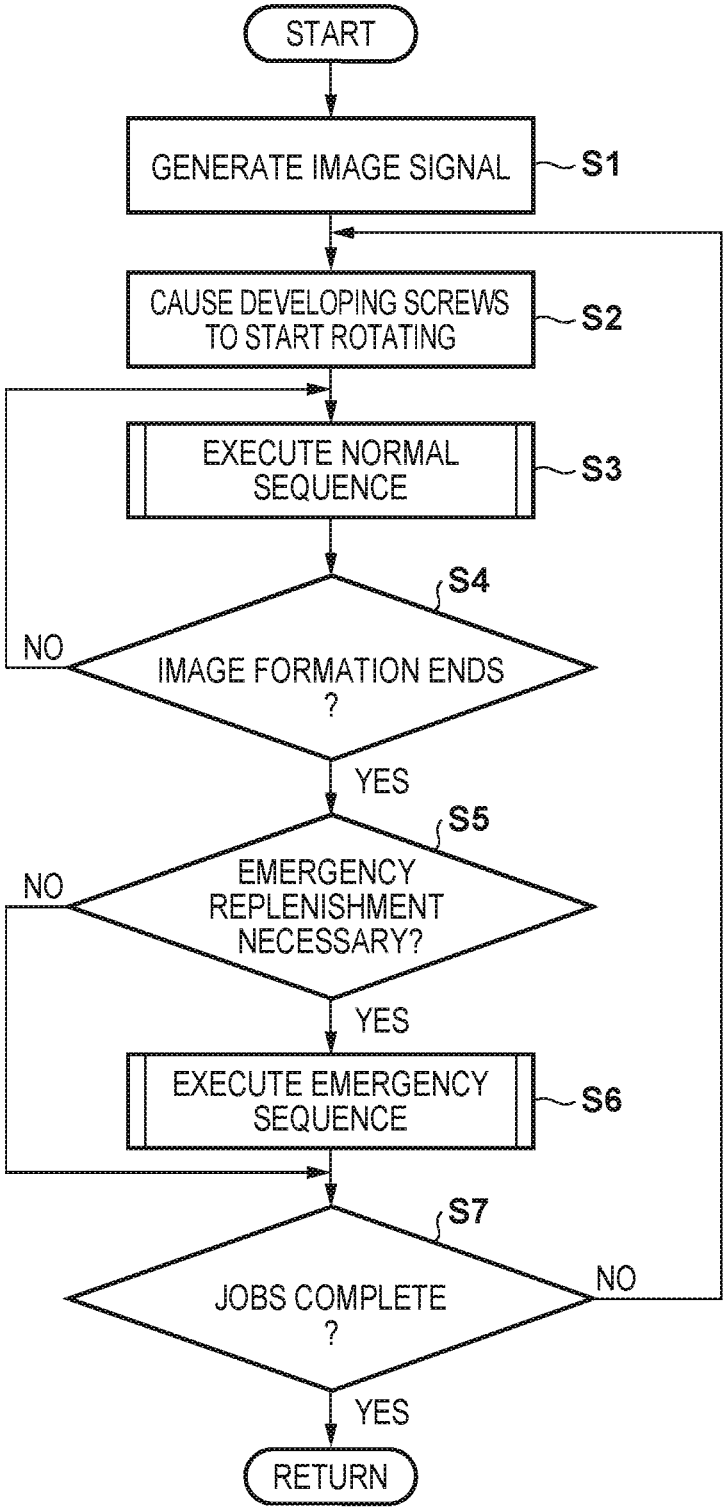
FIG. 4 is a flowchart for illustrating a replenishment control.
Figure 5:
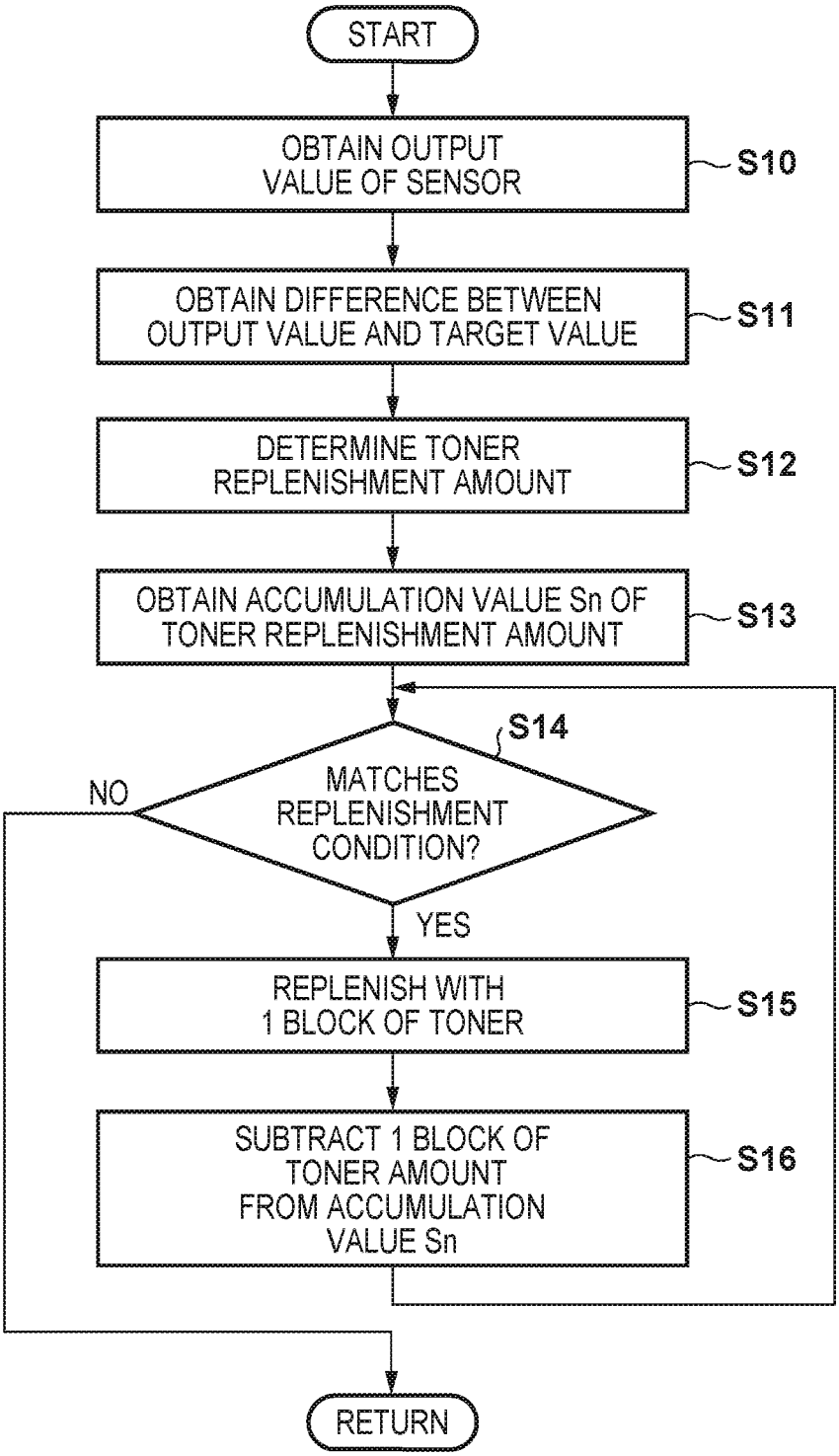
FIG. 5 is a flowchart for illustrating a normal sequence.
Figure 6:
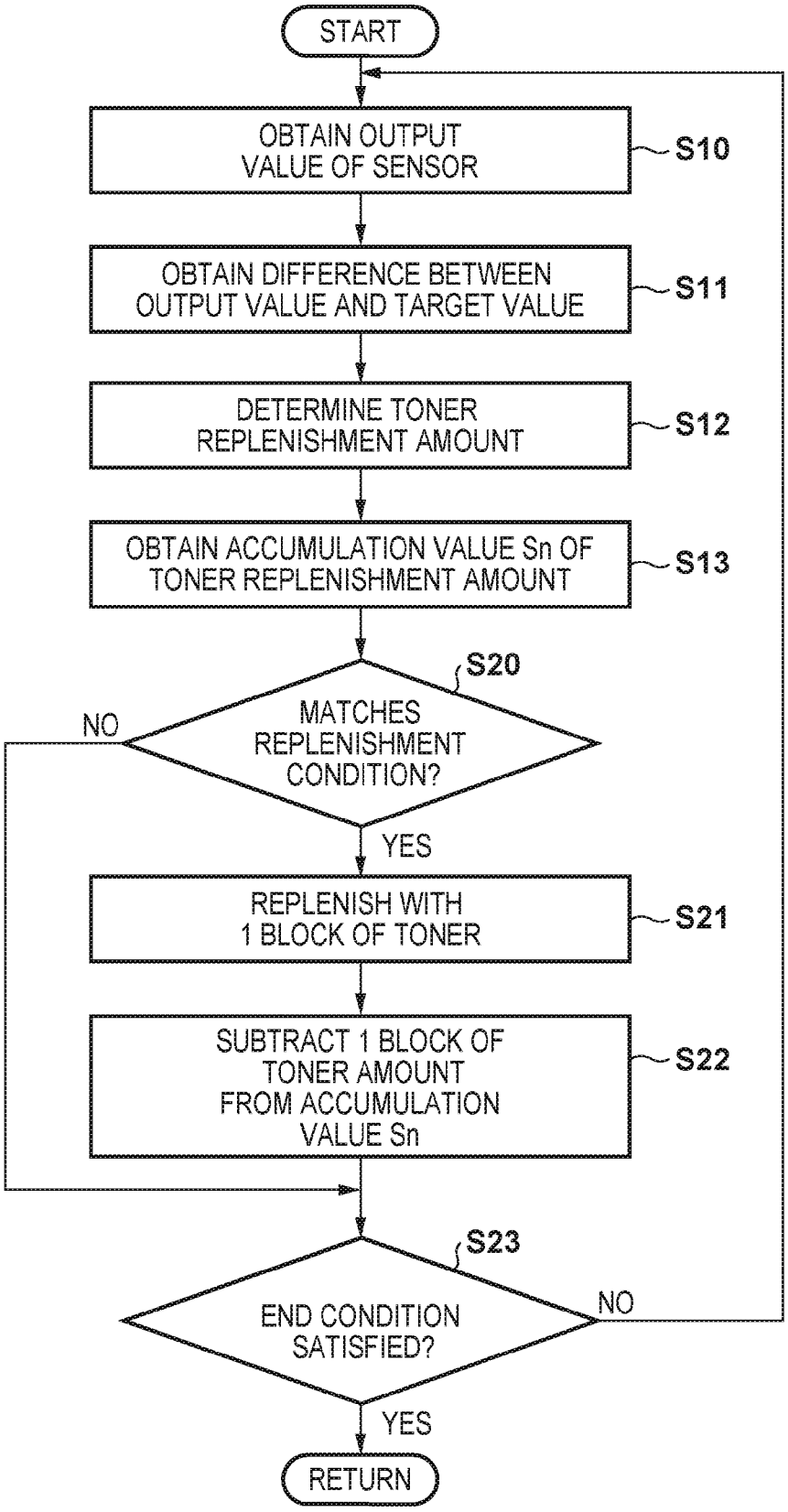
FIG. 6 is a flowchart for illustrating an emergency sequence.

Using FIG. 4 through FIG. 6, replenishment control of the present embodiment is explained in detail. A control program for executing this flowchart is stored in the ROM 103, and data is stored in the RAM 102. When an instruction for printing is received from a host computer or an operation unit connected to the I/O 104, the CPU 101 executes the following processing in accordance with the control program stored in the ROM 103.

In step S1, the CPU 101 generates an image signal using the processing circuit 34. The image signal is generated for each page of sheets on which images are formed. Accordingly, the CPU 101 and the processing circuit 34 function as image signal generation unit. In step S2, the CPU 101 causes the developing motor 68 to start rotating by controlling the motor driver 67. Accordingly, the CPU 101 functions as a motor control unit or a mixing control unit. With this, the developing motor 68 causes the screws 58 and 59 to rotate. In step S3, the CPU 101 starts normal replenishment (a normal sequence). Details of the normal sequence are explained later using FIG. 5. The CPU 101 functions as a normal replenishment control unit. In step S4, the CPU 101 determines whether or not image formation corresponding to an image signal (printing) ended. Accordingly, the CPU 101 functions as a determination unit. If printing ended, the CPU 101 advances to step S5, and if printing has not ended, the CPU 101 returns to step S3.

In step S5, the CPU 101 determines whether or not an emergency replenishment (an emergency sequence) is necessary based on an output value of the inductance sensor 20 (the T/D ratio which is an indicator of toner density). The CPU 101 functions as a determination unit. For example, when the replenishment of toner does not keep up, and a difference between the T/D ratio detected by the inductance sensor 20 and a target T/D ratio exceeds a threshold value, the CPU 101 determines that the emergency sequence is necessary. In other words, the difference (an inductor difference) between the output value of the inductance sensor 20 and the target value exceeding a threshold value may be made to be a moving condition (an emergency replenishment condition) for moving into the emergency sequence. Note that the output value of the inductance sensor 20 is inversely proportional to the T/D ratio. If an emergency replenishment is necessary, the CPU 101 advances to step S6, and if an emergency replenishment is not necessary, the CPU 101 advances to step S7.

In step S6, the CPU 101 starts the emergency sequence. Accordingly, the CPU 101 functions as an emergency replenishment control unit. Also, the CPU 101 causes an image forming operation to stop when the emergency sequence starts. In other words, the CPU 101 functions as a stoppage unit for stopping an image forming operation in which the image forming unit forms an image on a sheet based on the toner density detected by the detection unit. Details of the emergency sequence are explained later using FIG. 6. In step S7, the CPU 101 determines whether or not all jobs have ended based on print job data. The CPU 101 functions as a determination unit. For example, in the case of a print job for printing consecutively 10 images, when printing of all 10 images has completed, the CPU 101 determines that all jobs have ended. If all jobs have ended, the CPU 101 ends the processing in accordance with this flowchart. If all jobs have not ended, the CPU 101 returns to step S1.

(2) Normal Sequence

Using FIG. 5, the normal sequence (step S3) is explained in detail. In step S10, the CPU 101 obtains an output value (a voltage) of the inductance sensor 20. The CPU 101 functions as an obtaining unit. The output value (voltage) can be called a detection value of the inductance sensor 20, and is a value that is correlated (is inversely-proportional) to the T/D ratio. In step S11, the CPU 101 obtain a difference between the output value and a target value. This difference will be referred to an inductance difference. The CPU 101 functions as a difference calculation unit.

In step S12, the CPU 101 determines a toner supply amount Rn from the inductance difference using a PID (Proportional-Integral-Derivative) control. The CPU 101 functions as a replenishment amount determination unit. For example, the CPU 101 adds a product of a P gain and the difference, a product obtained by integrating differences to obtain an accumulated difference and further multiplying the accumulated difference by an I gain, and a product obtained by differentiating the difference and further multiplying the differentiated difference by a D gain. For example, the CPU 101 calculates the difference and multiplies the difference by a coefficient "P". Next, the CPU 101 accumulates the differences to calculate the cumulative value and multiplies the cumulative value by a coefficient "I". This sum is the toner supply amount Rn. Setting the D gain to 0, and only controlling PI (PI control), and setting the I gain and the D gain to 0 and only controlling P (P control) is encompassed in PID control. Note that the P gain, the D gain, and the I gain are determined in advance so that stability and controllability are good, and are stored in the ROM 103. The CPU 101 calculates amount of toner to be replenished by reading these parameters from the ROM 103.

In step S13, the CPU 101 obtains an accumulation value Sn of toner replenishment amount. The CPU 101 functions as an accumulation unit. For example, the CPU 101 retrieves a replenishment amount accumulation value obtained in a toner replenishment of the previous time (a sequence executed last (immediately previously) among the normal sequence and the emergency sequence) and saved in the RAM 102. The CPU 101 obtains the accumulation value of this time by adding the toner supply amount Rn of this time to the retrieved accumulation value, and overwrites the RAM 102. For example, an accumulation value Sn−1 of toner replenishment amount obtained by toner replenishment from a first time to an n−1th time is the accumulation value of the previous time. Note that when a toner replenishment is executed, the amount of toner replenished is decremented from the accumulation value. An accumulation value Sn of this time (in other words, an nth time) is obtained by adding the toner supply amount Rn of this time obtained in step S12 to the accumulation value Sn−1 of the previous time. Note that the accumulation value of the normal sequence and the accumulation value of the emergency sequence are explained as being common, but separate accumulation values may be managed. Additionally, the accumulation value Sn indicates a deficiency amount for toner in the developing unit 44.

In step S14, the CPU 101 determines whether or not the replenishment condition is satisfied. The CPU 101 functions as a replenishment determination unit. The replenishment condition may be that, for example, the accumulation value Sn exceeds a minimum replenishment amount Rmin set in advance. The minimum replenishment amount Rmin is set at a design stage of the image forming apparatus in advance in order to reduce frequent toner replenishment. Additionally, the minimum replenishment amount Rmin is more than a toner amount (a block toner amount Rb) replenished by driving the replenishment motor 70 for a unit time. The block toner amount is a minimum unit of toner replenishment amount. Note that replenishment of toner for each toner block is referred to as block replenishment. If the accumulation value Sn does not exceed the minimum replenishment amount Rmin, the replenishment condition is not satisfied, and therefore the CPU 101 ends the normal sequence and returns to the main sequence. On the other hand, if the accumulation value Sn exceeds the minimum replenishment amount Rmin, the replenishment condition is satisfied, and therefore the CPU 101 advances to step S15.

In step S15, the CPU 101 controls the motor driver 69 to cause the replenishment motor 70 to rotate, and replenishes the developing unit 44 with one block of toner. The CPU 101 functions as a motor control unit. In step S16, the CPU 101 subtracts the block toner amount Rb from the accumulation value Sn. The CPU 101 functions as a subtracting unit. After that, the CPU 101 returns to step S14. In other words, while the replenishment condition is satisfied, a toner is replenished by the block toner amount Rb. Additionally, because the output value of the inductance sensor 20 in the normal sequence tends not to fluctuate greatly, the output value is obtained only one time, and the toner replenishment amount is determined only one time.

(3) Emergency Sequence (Emergency Replenishment)

As is clear from FIG. 5, in the normal sequence, toner replenishment is executed in block units without image formation being stopped when the toner replenishment amount is determined. When determining the toner replenishment amount, the output value of the inductance sensor 20 is used, but the output value of the inductance sensor 20 is not referenced until toner replenishment completes when the toner replenishment amount is determined. Meanwhile, the emergency sequence is executed in the middle of forming a plurality of consecutive images (a duration after forming the preceding image and prior to forming the following image). In other words, the emergency sequence is a sequence in which image formation is first stopped, and during that stoppage duration toner is replenished. In the emergency sequence, new toner is replenished without the toner of the developing unit 44 being consumed, and therefore the speed at which toner increases is faster than in the normal sequence. For this reason, when returning to the normal sequence from the emergency sequence, it is possible that the output value of the inductance sensor 20 will not be stable. In other words, the time for the T/D ratio detected by the inductance sensor 20 to converge to a target value will become longer, or the emergency sequence will be moved into once again in spite of the fact that the toner density that is actually in the developing unit 44 is within a normal range. Accordingly, in addition to introducing the emergency sequence in the present embodiment, a method for causing the output value of the inductance sensor 20 to stabilize when returning from the emergency sequence to the normal sequence is further proposed. In particular, in the emergency sequence of the present embodiment, toner replenishment is executed considering a difference (an inductance difference) between the output value and the target value. In other words, if the inductance difference is great, the CPU 101 makes the toner increase speed faster. On the other hand, if the inductance difference becomes smaller, the CPU 101 makes the toner increase speed slower accordingly. With this, when returning to the normal sequence from the emergency sequence, the output value of the inductance sensor 20 will be stable.

Using FIG. 6, the emergency sequence (step S6) is explained in detail. Note that steps that are in common with the normal sequence are given the same reference numerals in the emergency sequence, and explanation is simplified. The CPU 101 executes step S10 through step S13 described above, and advances to step S20. In particular, step S10 of FIG. 6 corresponds to causing the detection unit to detect toner density in a duration from when the stoppage unit stops the image forming operation to when the image forming unit resumes the image forming operation. Also, step S11 corresponds to calculating the difference between the toner density and the target toner density. Note that in step S11, the calculated difference may be integrated (an accumulation addition). In this way, the CPU 101 is an example of a first calculation unit for calculating a difference between a toner density and a target toner density, and a second calculation unit for integrating the difference. Step S13 of FIG. 6 is an example of determining a determination value (accumulation value Sn) based on a computation result of the first calculation unit and a computation result of the second calculation unit. In other words, the CPU 101 functions as a determination unit for determining a determination value (accumulation value Sn).

In step S20, the CPU 101 determines whether or not the replenishment condition is satisfied. The CPU 101 functions as a determination unit. This determination processing is essentially the same as that step S14. If the replenishment condition is not satisfied, the CPU 101 advances to step S23. If the replenishment condition is satisfied, the CPU 101 advances to step S21. In this way, the CPU 101 functions as a controller for controlling, based on the determination value determined by the determination unit, the timing that the replenishment unit replenishes the storage unit with toner in the duration in which image formation is stopped.

In step S21, the CPU 101 controls the motor driver 69 to cause the replenishment motor 70 to rotate to replenish the developing unit 44 with one block of toner. The CPU 101 functions as a controller for controlling a timing for causing the conveying screw 62 to rotate (a timing for replenishing the developing unit 44 with toner). The conveying screw 62 is an example of a rotating body that performs a rotation operation. The CPU 101 functions as a motor control unit. In step S22, the CPU 101 subtracts the block toner amount Rb from the accumulation value Sn. The CPU 101 functions as a subtracting unit. After that, the CPU 101 advances to step S23.

In step S23, the CPU 101 determines whether or not a condition for ending the emergency sequence is satisfied. The CPU 101 functions as a determination unit. If the end condition is not satisfied, the CPU 101 returns to step S10. In this way, in the present embodiment, when 1 block of toner is replenished, the toner replenishment amount is updated based on a new output value of the inductance sensor 20 by returning to step S10. Meanwhile, if the end condition is satisfied, the CPU 101 ends the emergency sequence and returns to the main sequence.

The end condition may be, for example, comprised by two conditions. The CPU 101 may determine that the end condition is satisfied when both of the two conditions are satisfied, and may determine that the end condition is satisfied when at least one of the two conditions is satisfied. A first condition is, for example, that the inductance difference became smaller than a value (example: 0.1 [V]) determined in advance. This means that the output value of the inductance sensor sufficiently approaches the target value. A second condition is, for example, the accumulation value Sn of replenishment amount became smaller than a value (example: 400 [mg]) determined in advance. If the accumulation value Sn becomes sufficiently small, it becomes possible to replenish sufficiently with the normal sequence. Accordingly, the CPU 101 returns from the emergency sequence to the normal sequence soon, and the time in which image formation cannot be executed (so-called downtime) is reduced. In this way, when the condition for ending is satisfied (that is, the difference between the detected toner density and a predetermined toner density becomes smaller than a threshold value), an image forming operation is restarted.

(4) Condition to Move into Emergency Replenishment (Step S5)

Detailed explanation is given for a condition to move into the emergency replenishment (step S5) as explained in FIG. 4. Two conditions may be included in the condition to move into the emergency replenishment. The CPU 101 may determine that the emergency replenishment is necessary when both conditions are satisfied, and may determine that the emergency replenishment is necessary when at least one of the conditions is satisfied. A first condition is, for example, that the inductance difference is greater than or equal to a value (example: 0.2 [V]) determined in advance. This means that an inductance voltage deviates greatly from a target voltage. A second condition is, for example, the accumulation value Sn of the replenishment amount became greater than or equal to a value (example: 800 [mg]) determined in advance.

If high density images are formed consecutively, there are cases in which a toner consumption speed exceeds an upper limit value of a toner replenishment speed. For example, assume that when forming a solid image at a maximum density, 1000 [mg] of toner is consumed, the maximum toner amount that can be replenished in the duration in which one image is formed is 800 [mg]. Note that the maximum density is level 256, for example, if the density of the toner image is expressed from level 1 to level 256. In such a case, the toner in the developing unit 44 is reduced by 200 [mg] at a time. Accordingly, the maximum toner amount that can be replenished in the duration for forming one image may be the second condition.

Note that the CPU 101 can predict the deficiency amount of toner from the image signal, and therefore may determine the toner replenishment amount in the emergency sequence based on the image signal. However, it is possible that the output value will not be stable when returning from the emergency sequence to the normal sequence if the T/D ratio (the output value of the inductance sensor 20) in the developing unit 44 is not considered. Accordingly, in the present embodiment, the toner replenishment amount (accumulation value) is determined considering the output value of the inductance sensor 20 in the emergency sequence.

Figure 7:
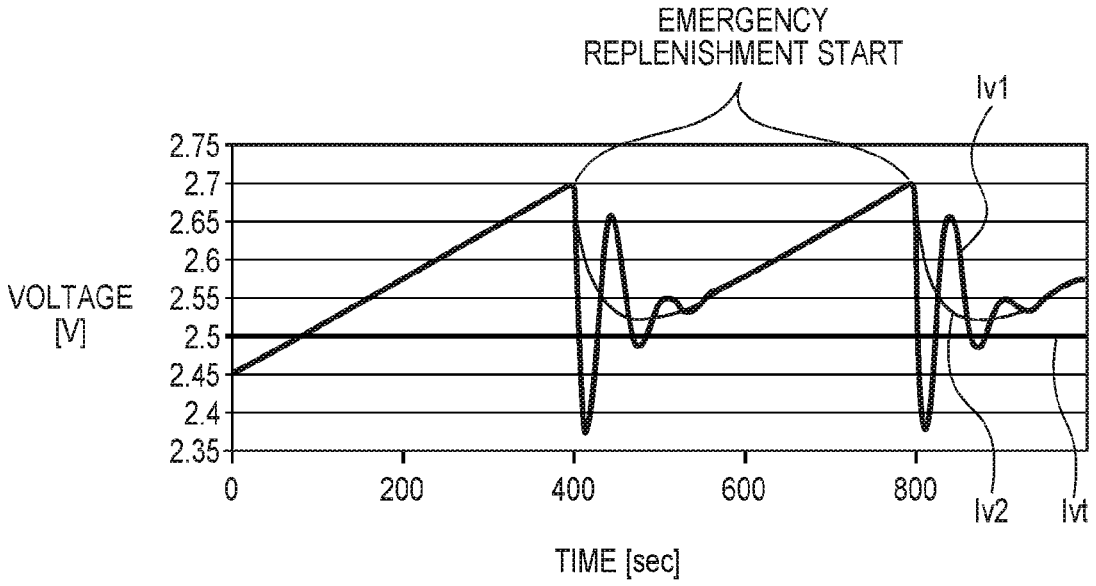
FIG. 7 is a view for illustrating a change in output values of an inductance sensor.

Using FIG. 7, an example of change of an output value of the inductance sensor 20 upon high density image formation is illustrated. A comparative example is an emergency sequence for determining a toner replenishment amount based on the image signal without considering the output value of the inductance sensor 20. The output value of the comparative example is Iv1. The output value of the present embodiment is Iv2. Ivt indicates a target value.

As FIG. 7 illustrates, because a toner is consumed at high speed when a high density image is formed, the emergency sequence is started when 400 seconds elapse from an image formation start time. In the comparative example, because the toner replenishment is executed without considering the output value of the inductance sensor 20, it takes time until the output value converges. Meanwhile, in the present embodiment, because the toner replenishment is executed considering the output value of the inductance sensor 20, the time until the output value converges is shortened.

Note that, the PID gain in the normal sequence and the PID gain in the emergency sequence may be set to be equivalent. With this, when switching from the normal sequence to the emergency sequence or switching from the emergency sequence to the normal sequence, the integrated value is taken over. As a result, the change in the output value of the inductance sensor 20 becomes smoother.

CONCLUSION

In accordance with this embodiment, the CPU 101 executes the emergency sequence in addition to the normal sequence. The normal sequence is a sequence executed in parallel with image formation, and is a first sequence for determining the toner replenishment amount in accordance with a difference between a target density and the toner density detected by the inductance sensor 20 while causing the screws 58 and 59 to operate, and replenishing the developing unit 44 with toner in accordance with this determined replenishment amount. Also, the emergency sequence is a sequence executed after causing image formation to stop, and is a second sequence for determining the toner replenishment amount in accordance with a difference between the target density and the toner density detected by the inductance sensor 20 while causing the screws 58 and 59 to operate, and replenishing the developing unit 44 with toner in accordance with this determined replenishment amount. The CPU 101 controls the replenishment motor 70 in accordance with the normal sequence when image formation is started. The CPU 101 controls the replenishment motor 70 in accordance with the emergency sequence when a state in which the replenishment amount of toner by the normal sequence is insufficient with respect to a consumption amount of toner by the image formation, and after that returns to the normal sequence. In accordance with this embodiment, by introducing the normal sequence and the emergency sequence, it becomes possible to reduce a fluctuation in toner density in the developing unit 44. Also, the replenishment amount of toner is determined in accordance with the toner density (the output value of the inductance sensor 20) of the developer in the emergency sequence. For this reason, when moving from the emergency sequence to the normal sequence, the T/D ratio will be stable.

As is explained in regards to step S12, toner replenishment control by the normal sequence and toner replenishment control by the emergency sequence may be PID control. The PID control is convenient as control for feeding back the output value of the inductance sensor 20 for the replenishment amount of toner. Additionally, the PID gain in accordance with the normal sequence and the PID gain of the replenishment control for toner by the emergency sequence may be set to be equivalent. With this, when switching between the normal sequence and the emergency sequence is executed, an integrated value is taken over, and a change in toner density becomes smoother. As explained in regards to step S11 and step S12, the CPU 101 may obtain a difference between the target density and the toner density detected by the inductance sensor 20, and may determine a toner replenishment amount by adding a product of a P gain and the difference, a product obtained by accumulating differences to an accumulated difference and further multiplying the accumulated difference by an I gain, and a product obtained by differentiating the difference and further multiplying the differentiated difference by a D. In the present embodiment, integration is realized simply by a cumulative addition.

As explained in regards to step S5, the CPU 101 may function as a first determination unit for determining whether or not a first moving condition for moving into the emergency sequence from the normal sequence is satisfied based on the toner density detected by the inductance sensor 20. When the CPU 101 determines that the first moving condition is satisfied, it moves into the emergency sequence from the normal sequence. The first moving condition is, for example, that a difference between the toner density detected by the inductance sensor 20 and the target density exceeds a threshold value. As described above, when a state in which the toner consumption speed exceeds the toner replenishment speed continues, the toner density deviates from the target density. If this is neglected, an unevenness will occur in an image density of the toner image, and a lowering of the image density will be noticeable in an image region that should be of a high density. Accordingly, an emergency sequence that causes image formation to stop, and causes toner density to recover becomes necessary.

As explained in regards to step S23, the CPU 101 may function as a second determination unit for determining whether or not a second moving condition for moving into the normal sequence from the emergency sequence is satisfied based on the toner density detected by the inductance sensor 20. When the CPU 101 determines that the second moving condition is satisfied, it moves into the normal sequence from the emergency sequence. The second moving condition is, for example, that a difference between the toner density detected by the inductance sensor 20 and the target density becomes less than or equal to a threshold value. In other words, if the difference between the toner density and the target density becomes sufficiently small, the CPU 101 returns to the normal sequence from the emergency sequence. This is because if the difference between the toner density and the target density becomes sufficiently small, unevenness in the density of the toner image or the like tends not to occur even if toner is replenished in parallel to image formation.

As explained using FIG. 5, the CPU 101, in the normal sequence, obtains an accumulation value by accumulating the toner replenishment amount based on the toner density detected by the inductance sensor 20, and determines whether or not the accumulation value satisfies a replenishment condition. The CPU 101 causes the replenishment motor 70 to replenish a predetermined amount of toner if this accumulation value satisfies the replenishment condition, and subtracts the predetermined amount from that accumulation value. Until the accumulation value obtained by subtracting that predetermined amount does not satisfy the replenishment condition, the CPU 101 causes the replenishment motor 70 to replenish toner by the predetermined amount.

As explained using FIG. 6, the CPU 101, in the emergency sequence, obtains an accumulation value by accumulating the toner replenishment amount based on the toner density detected by the inductance sensor 20, and determines whether or not the accumulation value satisfies a replenishment condition. The CPU 101 causes the replenishment motor 70 to replenish with a predetermined amount of toner if this accumulation value satisfies this replenishment condition, and subtracts the predetermined amount from that accumulation value. If the condition for returning to the normal sequence from the emergency sequence is not satisfied, the CPU 101 causes the inductance sensor 20 to once again detect the toner density, updates the toner replenishment amount based on that toner density, and returns to the normal sequence if the condition for returning to the normal sequence from the emergency sequence is satisfied. In particular, the toner replenishment amount is updated in accordance with the toner density in the developing unit 44. In the emergency sequence of the present embodiment, toner replenishment is executed considering the inductance difference. In other words, if the inductance difference is great, the CPU 101 makes the toner increase speed faster. On the other hand, if the inductance difference becomes smaller, the CPU 101 makes the toner increase speed slower accordingly. In other words, the frequency at which the block replenishment is executed in a state in which the inductance difference is small is smaller than the frequency at which block replenishment is executed in a state in which the inductance difference is large. With this, when returning to the normal sequence from the emergency sequence, the output value of the inductance sensor 20 will be stable.

The RAM 102 functions as a storage unit for storing the accumulation value of the toner replenishment amount. The CPU 101 may use the accumulation value stored in the RAM 102 commonly for the normal sequence and the emergency sequence. With this, because an accumulation value is taken over between the normal sequence and the emergency sequence, a change in toner density tends to become smoother.

The CPU 101, in the emergency sequence, may adjust the toner replenishment amount in proportion to the difference between the target density and the toner density detected by the inductance sensor 20. In other words, the CPU 101 may make the speed of the increase in toner density faster if the inductance difference is large, and when the inductance difference becomes smaller, may make the speed of increase in toner density slower accordingly. With this, toner density in the developing unit 44 (the T/D ratio) further tends to be stable when moving into the normal sequence from the emergency sequence.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-007189, filed Jan. 16, 2015 which is hereby incorporated by reference herein in its entirety.

What is claimed is:

1. An image forming apparatus, comprising:

a storage unit configured to store developer including a toner and a carrier;

an image forming unit configured to form an image on a sheet using the toner stored in the storage unit;

a replenishment unit configured to replenish the storage unit with toner;

a detection unit arranged in the storage unit and configured to detect a toner density of the developer in the storage unit;

a stoppage unit configured to stop, based on the toner density detected by the detection unit, an image forming operation of the image forming unit forming the image on the sheet;

a first calculation unit configured to control the detection unit to detect the toner density in a duration from when the stoppage unit stops the image forming operation to when the image forming unit resumes the image forming operation, and configured to calculate a difference between the toner density and a target toner density;

a second calculation unit configured to accumulate the difference calculated by the first calculation unit to calculate a cumulative value of the difference;

a determination unit configured to determine a value for determining whether or not replenishment of the toner is required, based on the difference calculated and the cumulative value calculated; and a controller configured to control a timing at which the replenishment unit replenishes the storage unit with the toner in the duration based on the value determined by the determination unit.

2. The image forming apparatus according to claim 1, wherein the controller, in a state in which the image forming operation is executed, controls the timing at which the replenishment unit replenishes the storage unit with the toner based on the toner density detected by the detection unit.

3. The image forming apparatus according to claim 1, wherein the replenishment unit comprises a rotating body; and the replenishment unit executes a rotation operation of the rotating body in accordance with a timing at which the storage unit is replenished with the toner.

4. The image forming apparatus according to claim 1, wherein the image forming unit resumes the image forming operation after a difference between the toner density detected by the detection unit and a predetermined toner density becomes smaller than a threshold value.

5. An image forming apparatus comprising:

an image carrier on which an electrostatic latent image is formed;

a development unit including a storage unit for storing a developer including a toner and a carrier, a mixing unit for mixing the developer stored in the storage unit, and a developer carrier for developing the electrostatic latent image formed on the image carrier by the toner of the developer stored in the storage unit;

a detection unit configured to detect a toner density of the developer stored in the storage unit;

a replenishment unit configured to replenish the storage unit with toner; and a control unit configured to control the replenishment unit, wherein the control unit comprises:

a first sequence which is a sequence executed in parallel to image formation, and which is for determining a toner replenishment amount in accordance with a difference between a target density and the toner density detected by the detection unit while causing the mixing unit to operate, and replenishing the storage unit with toner in accordance with the determined replenishment amount; and a second sequence which is a sequence executed after having caused image formation to stop, and which is for determining a toner replenishment amount in accordance with a difference between the target density and the toner density detected by the detection unit while causing the mixing unit to operate, and replenishing the storage unit with toner in accordance with the determined replenishment amount, wherein the control controls the replenishment unit in accordance with the first sequence when image formation starts, controls the replenishment unit in accordance with the second sequence when the toner replenishment amount according to the first sequence is insufficient with respect to a toner consumption amount due to the image formation, and returns to the first sequence from the second sequence.

6. The image forming apparatus according to claim 5, wherein both of toner replenishment control according to the first sequence and toner replenishment control according to the second sequence are PID (Proportional-Integral-Derivative) control.

7. The image forming apparatus according to claim 6, wherein a PID gain according to the first sequence is equivalent to a PID gain of toner replenishment control according to the second sequence.

8. The image forming apparatus according to claim 6, wherein the control unit obtains the difference between the target density and the toner density detected by the detection unit, and determines the toner replenishment amount by adding a product of a P gain and the difference, a product obtained by integrating the difference and further multiplying the accumulated difference by an I gain, and a product obtained by differentiating the difference and further multiplying the differentiated difference by a D gain.

9. The image forming apparatus according to claim 5, further comprising:

a first determination unit configured to, based on the toner density detected by the detection unit, determine whether or not a first moving condition for moving into the second sequence from the first sequence is satisfied, wherein the control unit moves into the second sequence from the first sequence when the first determination unit determines that the first moving condition is satisfied.

10. The image forming apparatus according to claim 9, wherein the first moving condition is that the difference between the target density and the toner density detected by the detection unit exceeds a threshold value.

11. The image forming apparatus according to claim 5, further comprising a second determination unit configured to, based on the toner density detected by the detection unit, determine whether or not a second moving condition for moving into the first sequence from the second sequence is satisfied, wherein the control unit moves into the first sequence from the second sequence when the second determination unit determines that the second moving condition is satisfied.

12. The image forming apparatus according to claim 11, wherein the second moving condition is that the difference between the target density and the toner density detected by the detection unit is less than or equal to a threshold value.

13. The image forming apparatus according to claim 5, wherein the control unit in the first sequence obtains an accumulation value by accumulating the toner replenishment amount based on the toner density detected by the detection unit and determines whether or not the accumulation value satisfies a replenishment condition, and if the accumulation value satisfies the replenishment condition, causes the replenishment unit to replenish with toner by a predetermined amount until an accumulation value obtained by subtracting the predetermined amount does not satisfy the replenishment condition by causing the replenishment unit to replenish by the predetermined amount of toner and subtracting the predetermined amount from the accumulation value.

14. The image forming apparatus according to claim 13, further comprising a storage unit configured to store an accumulation value of the toner replenishment amount, wherein the control unit uses the accumulation value stored in the storage unit commonly between the first sequence and the second sequence.

15. The image forming apparatus according to claim 5, wherein the control unit in the second sequence obtains an accumulation value by accumulating the toner replenishment amount based on the toner density detected by the detection unit and determines whether or not the accumulation value satisfies a replenishment condition, and if the accumulation value satisfies the replenishment condition, causes the replenishment unit to replenish with toner by a predetermined amount, and subtracts the predetermined amount from the accumulation value, and if a condition for returning to the first sequence from the second sequence is not satisfied, causes once again the detection unit to detect the toner density, and updates, based on the toner density, the toner replenishment amount, and if the condition for returning to the first sequence from the second sequence is satisfied, returns to the first sequence from the second sequence.

16. The image forming apparatus according to claim 5, wherein the control unit in the second sequence adjusts the toner replenishment amount in proportion to a difference between the target density and the toner density detected by the detection unit.

* * * * *